US007689148B2

(12) United States Patent
Okabe

(10) Patent No.: US 7,689,148 B2
(45) Date of Patent: Mar. 30, 2010

(54) IMAGE FORMING APPARATUS WITH DRUM DRIVING MECHANISM

(75) Inventor: Yasushi Okabe, Nagoya (JP)

(73) Assignee: Brother Kogyo Kabushiki Kaisha, Aichi-Ken (JP)

( * ) Notice: Subject to any disclaimer, the term of this patent is extended or adjusted under 35 U.S.C. 154(b) by 901 days.

(21) Appl. No.: 11/451,311

(22) Filed: Jun. 13, 2006

(65) Prior Publication Data

US 2006/0291904 A1 Dec. 28, 2006

(30) Foreign Application Priority Data

Jun. 15, 2005 (JP) ..... P2005-174964

(51) Int. Cl.
*G03G 15/00* (2006.01)

(52) U.S. Cl. ..... 399/167; 399/159

(58) Field of Classification Search ..... 399/117, 399/159, 167

See application file for complete search history.

(56) References Cited

U.S. PATENT DOCUMENTS 4,398,374 A * 8/1983 Amann et al.
4,621,919 A * 11/1986 Nitanda et al. ..... 399/117
5,606,890 A * 3/1997 Luckas
5,881,342 A 3/1999 Makino et al.
6,330,409 B1 * 12/2001 Watanabe et al. ..... 399/167

FOREIGN PATENT DOCUMENTS

| | | | |
|---|---|---|---|
| JP | 9-90853 | A | 4/1997 |
| JP | 10-268602 | A | 10/1998 |
| JP | 11-338312 | A | 12/1999 |
| JP | 2000-35090 | A | 2/2000 |

* cited by examiner

*Primary Examiner*—David M Gray
*Assistant Examiner*—Laura K Roth
(74) *Attorney, Agent, or Firm*—McDermott Will & Emery LLP

(57) ABSTRACT

An image forming apparatus includes a developing unit, a transfer unit, and a photosensitive drum assembly. The drum assembly has a photosensitive drum, a driven section integral with the photosensitive drum, and a driving section which transmits a driving force to the driven section to rotate the photosensitive drum. Either one of the driven section and the driving section comprises a contact face, which constitutes a part of a plane including a rotation axis of the photosensitive drum. The other of the driven section and the driving section comprises a single boss, which is substantially in parallel with the rotation axis and contacts the contact face.

18 Claims, 11 Drawing Sheets

IMAGE FORMING APPARATUS WITH DRUM DRIVING MECHANISM

CROSS REFERENCE TO RELATED APPLICATION

This application claims priority from Japanese Patent Application No. 2005-174964, filed Jun. 15, 2005, the contents of which are hereby incorporated by reference into the present application.

TECHNICAL FIELD

Aspects of the present invention relate to an image forming apparatus including a driving force transmitting mechanism for rotating a rotary body.

BACKGROUND

A rotary body, such as an image carrier, is provided in an image forming apparatus of an electro-photographic system. Various mechanisms for transmitting driving force to the rotary body in order to rotate the rotary body at constant velocity have been proposed. For example, JP-A-9-90853 discloses forming four elongated holes extending in a radial direction at every 90 degrees in a disc-like member. The disc-like member rotates integrally with a driving gear, while four pins provided on a photosensitive drum are engaged with the elongated holes, thereby canceling a force applied to the photosensitive drum in the radial direction.

However, although the above mechanism can perform accurate constant-angular-speed transmission, at least in principle, it has a complicated structure and is expensive. Since the disc-like member intervenes between the driving gear and the photosensitive drum, and the four pins are slidably engaged with the four elongated holes, backlashes (gaps) are accumulated at four positions between the driving gear and the photosensitive drum. Further, because plural members, such as the pins, elongated holes and disc-like member, are interposed between the driving gear and the photosensitive drum, driving may become inaccurate due to elastic deformation, inclination, or the like of the plural members. This problem can be solved by making the members accurate to decrease the backlashes, and by employing metal instead of resin as material of the members. However, the cost further increases.

Aspects of this invention provide a driving force transmitting mechanism for a rotary body, which is manufactured at low cost and easily rotates the rotary body, such as a photosensitive drum, at constant velocity.

SUMMARY

According to an aspect of the present invention, an image forming apparatus includes: a developing unit; a transfer unit; and a photosensitive drum assembly. The photosensitive drum assembly includes: a photosensitive drum; a driven section, which is provided integrally with the photosensitive drum; and a driving section, which transmits a driving force to the driven section to rotate the rotary body. Either one of the driven section and the driving section has a contact face, which constitutes a part of a plane including a rotation axis of the rotary body. The other of the driven section and the driving section is a single boss, which is substantially in parallel with the rotation axis and contacts with the contact face.

According to another aspect of the present invention, a photosensitive drum assembly includes a photosensitive drum; a driven section, which is provided integrally with the photosensitive drum; and a driving section, which transmits a driving force to the driven section to rotate the rotary body. Either one of the driven section and the driving section has a contact face, which constitutes a part of a plane including a rotation axis of the rotary body. The other of the driven section and the driving section is a single boss, which is substantially in parallel with the rotation axis and contacts with the contact face.

According to another aspect of the present invention, a driving force transmitting mechanism for a rotary body includes: a driven section, which is provided integrally with the rotary body; and a driving section, which transmits a driving force to the driven section to rotate the rotary body. Either one of the driven section and the driving section has a contact face, which constitutes a part of a plane including a rotation axis of the rotary body. The other of the driven section and the driving section is a single boss, which is formed substantially in parallel with the rotation axis and contacts with the contact face.

DETAILED DESCRIPTION OF ILLUSTRATIVE ASPECTS

Figure 1:
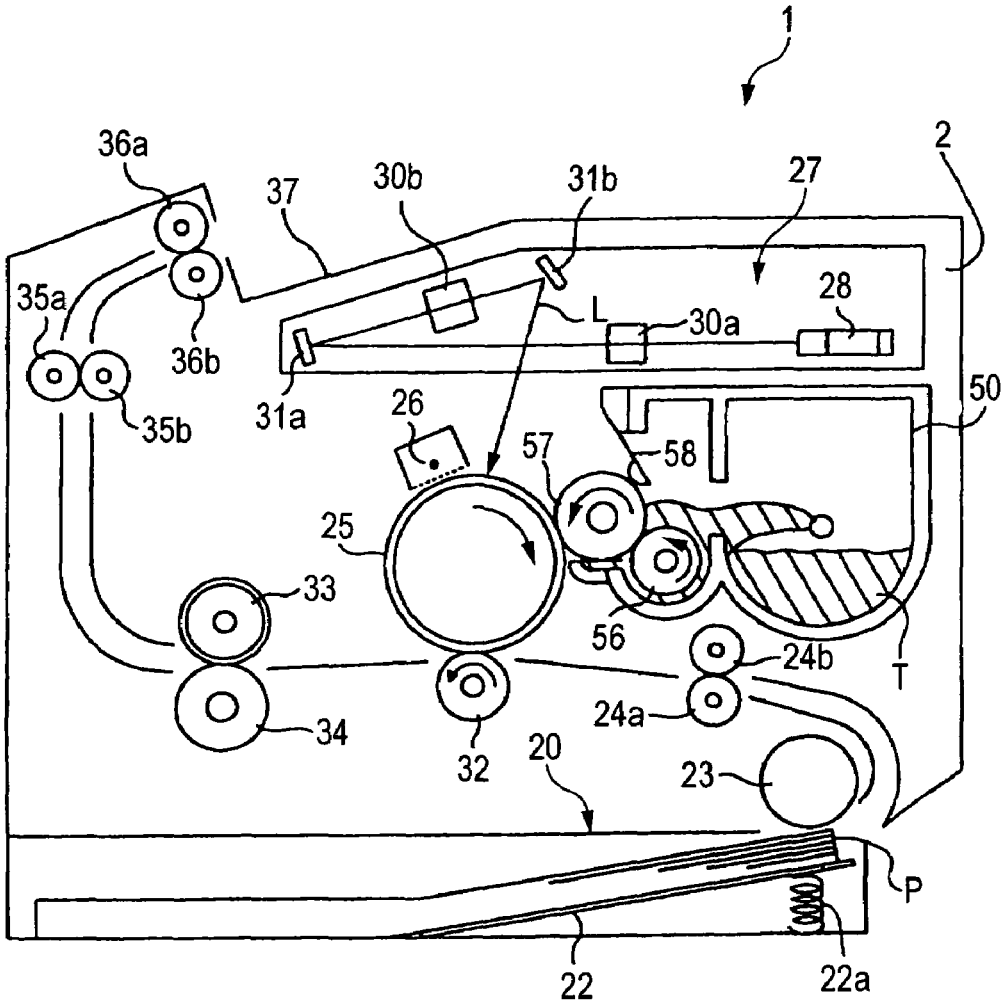
FIG. 1 is a sectional view schematically showing a laser printer to which an aspect of the invention is applied.

An aspect of the invention will be described referring to the drawings. FIG. 1 is a sectional view schematically showing a laser printer 1 according to an aspect of the invention. As shown in FIG. 1, this laser printer 1 is provided with a feeder unit 20 for feeding a sheet P, in a bottom part of a main body casing 2. The feeder unit 20 includes a paper pressing plate 22, which holds the sheet P in a stacked state, a paper feeding roller 23, which performs supply of the sheets P that are stacked and held; and a compression spring 22*a*, which urges the paper pressing plate 22 toward the paper feeding roller 23.

The sheet P, which is at the uppermost position of the stack is stacked and held on the paper pressing plate 22, is fed at a predetermined timing.

At a downstream side from the paper feeding roller 23 in a sheet conveying direction, a pair of registration rollers 24*a*, 24*b* are rotatably provided so as to convey the sheet P to a transfer position formed between a photosensitive drum 25 and a transfer roller 32, which will be described below, at a predetermined timing.

The photosensitive drum 25 includes an organic photosensitive body, which contains positively chargeable electrifying material, for example, positively chargeable polycarbonate as a main component. In this aspect, the photosensitive drum 25 includes a cylindrical sleeve made of aluminum in a cylindrical shape, and a photosensitive layer of polycarbonate dispersed with photosensitive resin. The photosensitive layer has a predetermined thickness (for example, 20 μm) and is formed on an outer periphery of the cylindrical sleeve. A charger 26 is arranged at a position opposed to the photosensitive drum 25. A laser beam L is irradiated from a laser scanner unit 27 to a downstream side in a rotation direction of the photosensitive drum 25.

The charger 26 is a positively chargeable scorotron type charger in which corona discharge is generated from a charging wire made of tungsten or the like, for example, and positively charges a surface of the photosensitive drum 25. The laser scanner unit 27 includes a polygon mirror (hexahedral mirror) 28, which is rotary driven while reflecting a laser beam L generated by a laser beam generator (not shown); a pair of lenses 30*a*, 30*b*; and a pair of mirrors 31*a*, 31*b*. The laser scanner unit 27 scans and exposes the surface of the photosensitive drum 25 by the laser beam L according to an image to be formed. In this manner, an electrostatic latent image is formed on the photosensitive drum 25 by cooperation of the charger 26 and the laser scanner unit 27. The electrostatic latent image is developed by toner T supplied from a developer cartridge 50, which will be described below. This toner T is transferred to the sheet P, which has been conveyed to the transfer position between the photosensitive drum 25 and the transfer roller 32, thereby forming the image on the sheet P.

The sheet P, on which the image has been formed, is clamped between a heating roller 33 and a pressurizing roller 34, and the image by the toner T is fixed. Thereafter, the sheet P is conveyed by a pair of conveying rollers 35*a*, 35*b* and a pair of discharging rollers 36*a*, 36*b*, and then, discharged on the discharging tray 37, which is provided on an upper face of the main body casing 2.

The developer cartridge 50 contains therein the toner T as a positively chargeable non-magnetic mono-component developer. This toner T is conveyed to a surface of a developing roller 57 by means of a supply roller 56, and regulated to a predetermined thickness by a layer thickness regulating blade 58. Then, the toner T is conveyed to the surface of the photosensitive drum 25 to serve for developing. The toner T is charged by contacting with the layer thickness regulating blade 58 and is transferred to the electrostatic latent image, which has been formed on the photosensitive drum 25, by electrostatic force. Therefore, it is possible to form a clear image on the sheet P, by transferring the toner T to the electrostatic latent image at a uniform thickness, and transferring it to the sheet P.

Figure 2A:
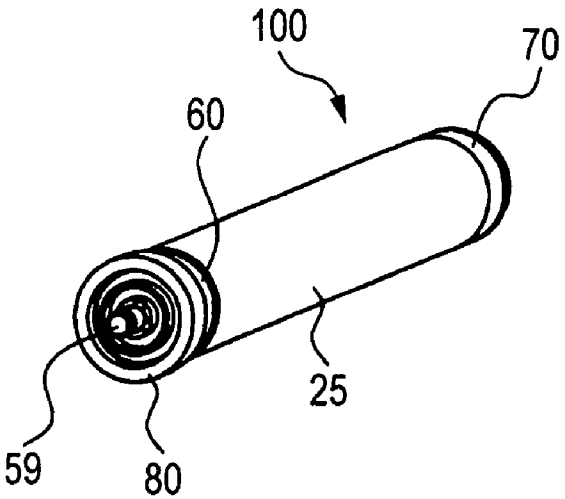
FIGS. 2A and 2B are a perspective view and a front view showing a photosensitive drum assembly of the laser printer.
Figure 2B:
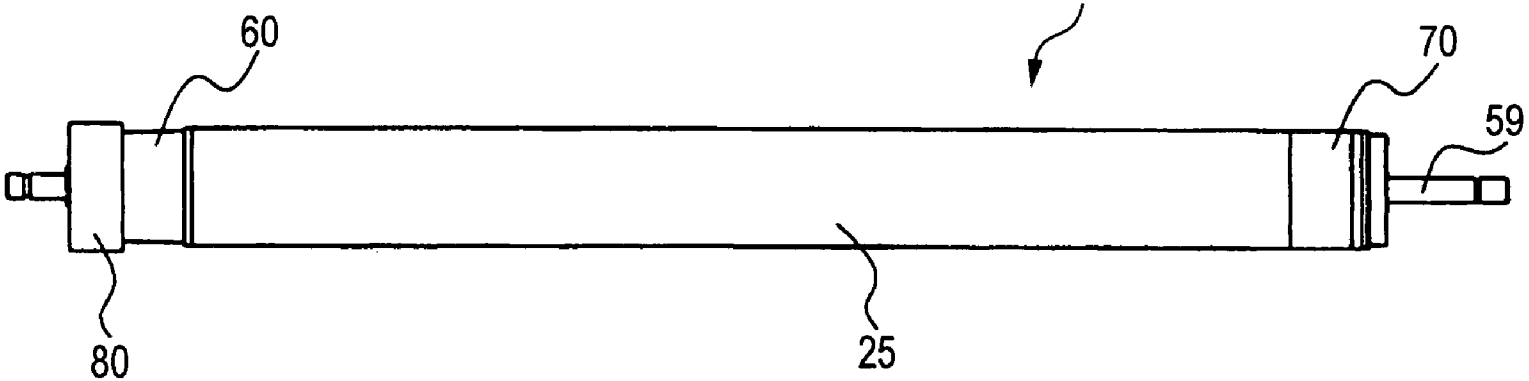
Figure 3:
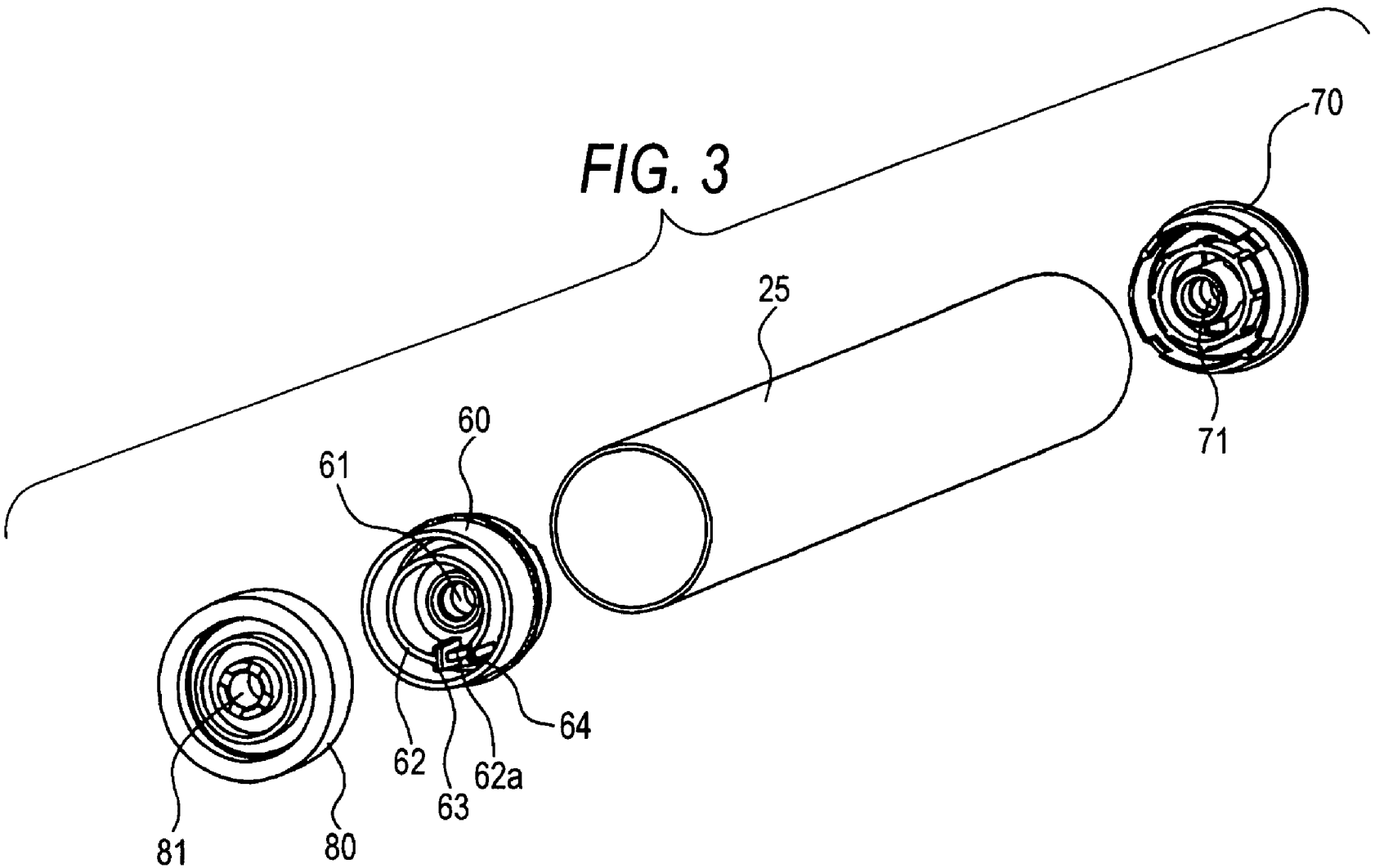
FIG. 3 is an exploded perspective view showing the photosensitive drum assembly.

A driving mechanism for the photosensitive drum 25 according to the aspect of the invention will be described. FIG. 2A is a perspective view showing a photosensitive drum assembly 100, which includes the photosensitive drum 25 and accessories. FIG. 2B is a front view showing the photosensitive drum assembly 100. FIG. 3 is an exploded perspective view showing the photosensitive drum assembly excluding a shaft 59. As shown in FIGS. 2A, 2B and 3, flanges 60 and 70 are fitted to both ends in an axial direction of the photosensitive drum 25. The flanges 60, 70 are provided with holes 61, 71, which have slightly larger diameters than the shaft 59. The shaft 59 is inserted through the holes 61, 71, thereby rotatably supporting the photosensitive drum 25. Both ends of the shaft 59 are fixed to a main body of the laser printer 1. A drum gear 80, to which a driving force is transmitted from a main body gear 90 provided on the main body of the laser printer 1 (See FIG. 6), is provided outside one of the flanges 60 in an axial direction.

Figure 4:
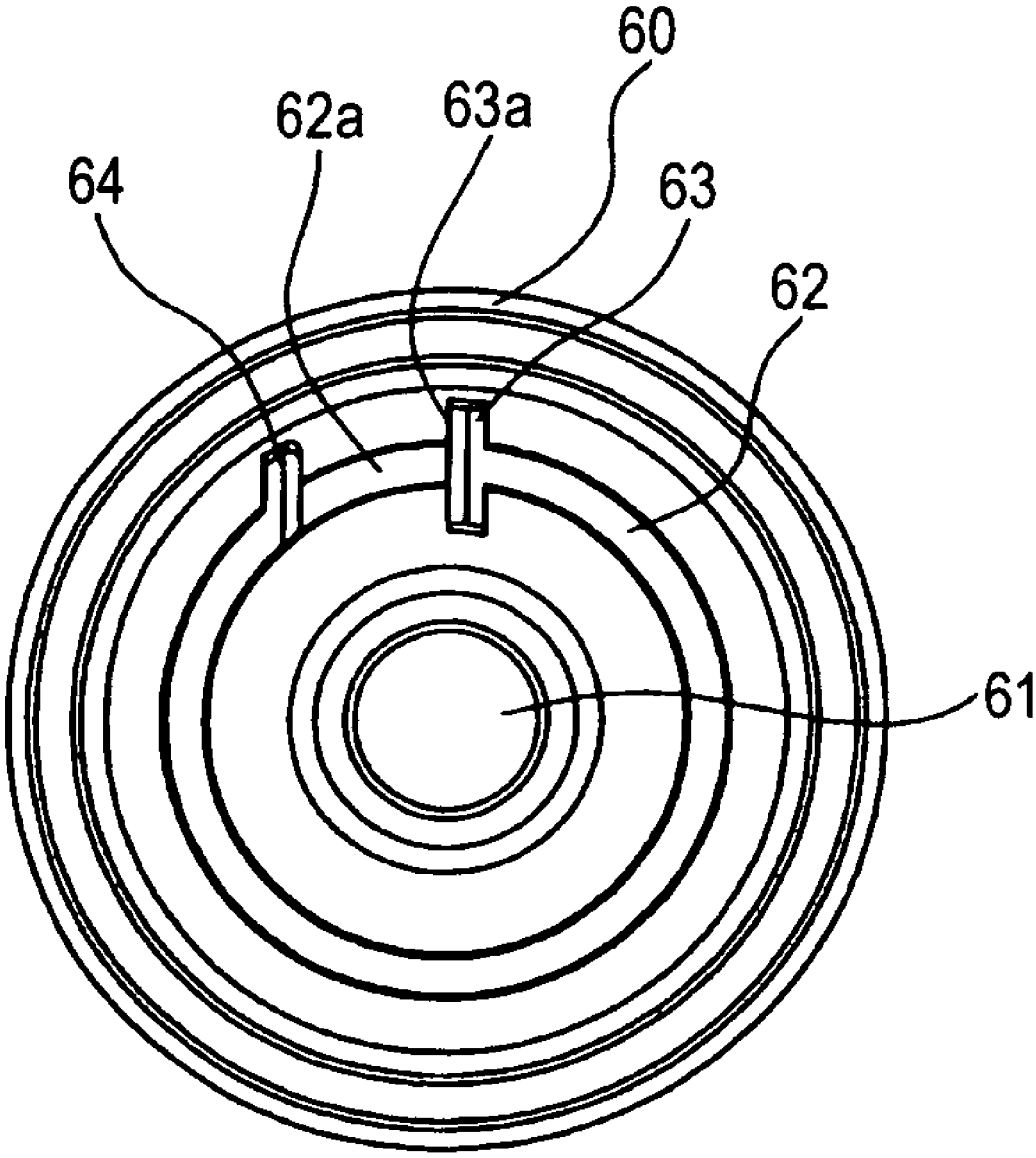
FIG. 4 is a side view showing a flange in the photosensitive drum assembly.

Outer peripheries of the flanges 60, 70 are formed as cylindrical faces having substantially the same diameter as the photosensitive drum 25, and the end portions of the flanges 60, 70 adjacent to the photosensitive drum 25 are designed so as to be fitted into the photosensitive drum 25. Moreover, an annular rib 62, which is concentric with the hole 61 is provided uprightly, inside the outer peripheral face of the flange 60. The annular rib 62 is provided with a receiving plate portion 63 and a backlash receiving portion 64. As shown in FIG. 4, an end face 63*a* of the receiving plate portion 63 opposed to the backlash receiving portion 64 constitutes a part of a plane containing a center axis of the hole 61. The backlash receiving portion 64 is formed as a plate in parallel with the receiving plate portion 63 and arranged at a predetermined distance from the receiving plate portion 63.

A part 62*a* of the annular rib 62, which is arranged between the receiving plate portion 63 and the backlash receiving portion 64, is formed to be lower in an axial direction of the photosensitive drum 25 (See FIG. 3). The receiving plate portion 63 is continued to the annular rib 62 at its center in a lateral direction. The connection portion between the receiving plate portion 63 and the annular rib 62 is formed in a substantially T-shape in a side view. Moreover, the backlash receiving portion 64 is continued to the annular rib 62 at its end close to the hole 61. The connection portion between the receiving plate portion 63 and the annular rib 62 is formed in a substantially L-shape in a side view.

Figure 5A:
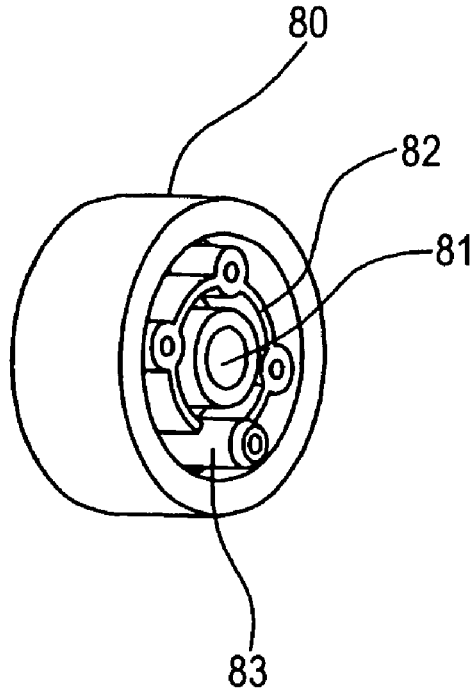
FIGS. 5A and 5B are a perspective view and a side view showing a drum gear in the photosensitive drum assembly.
Figure 5B:
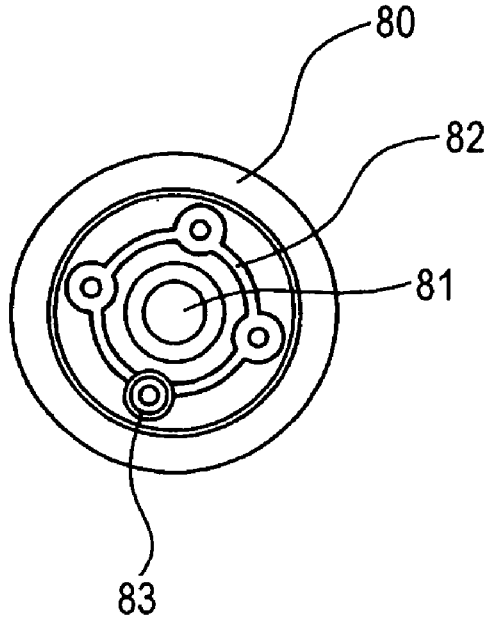

FIG. 5A is a perspective view showing one side of the drum gear 80 close to the flange 60, and FIG. 5B is a side view of the same. An outer periphery of the drum gear 80 is formed as a cylindrical face having substantially the same diameter as the flanges 60, 70 and the photosensitive drum 25. The drum gear 80 is a spur gear having teeth (not shown) on its surface. It is to be noted that a helical gear may be employed instead of the spur gear. As shown in FIGS. 5A and 5B, the drum gear 80 is also provided with a hole 81 and an annular rib 82 at positions opposed to the hole 61 and the annular rib 62. A boss 83 in a columnar shape is projected from a part of the annular rib 82 toward the flange 60 in parallel with a center axis of the hole 81. When the hole 81 is inserted over the shaft 59, the boss 83 is inserted with a slight clearance between the receiving plate portion 63 and the backlash receiving portion 64. For this reason, when the outer peripheral face of the drum gear 80 comes into engagement with the main body gear 90 and the driving force is transmitted, this driving force is transmitted to the flange 60 from the boss 83 by contacting with the receiving plate portion 63. Accordingly, the photosensitive drum 25 that is integrally fixed to the flange 60 is rotated. Because the part 62*a* of the annular rib 62 is formed lower in an axial direction, a distal end of the boss 83 does contact the part 62*a*.

Operation of the driving mechanism for the photosensitive drum 25 will be described. For smooth rotation of the flanges 60, 70, and the drum gear 80, predetermined clearances must be provided in the holes 61, 71, 81 with respect to the shaft 59.

Figure 6:
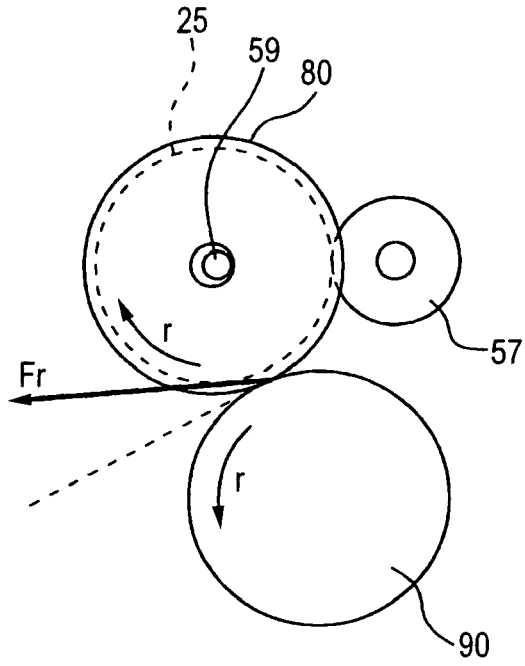
FIG. 6 is a schematic view showing forces applied to the photosensitive drum assembly.

However, various forces are exerted on the photosensitive drum assembly 100, as shown in FIG. 6. For example, a pressure is applied to the photosensitive drum 25 from the developing roller 57. Moreover, when the drum gear 80 is rotated in a direction of an arrow mark r in mesh with the main body gear 90, the drum gear 80 receives an urging force Fr and the pitch of the drum gear 80 increases in the direction of the urging force Fr. Consequently, the above mentioned clearance narrows in a certain direction, and the flanges 60, 70, and the drum gear 80 becomes eccentric with respect to the shaft 59. In addition to the pressure from the developing roller 57, the photosensitive drum 25 may receive pressures from a contact-type charger, a cleaner and so on, in some cases. In this case, the photosensitive drum 25 is made eccentric in a direction according to a resultant force of the respective pressures.

Figure 7:
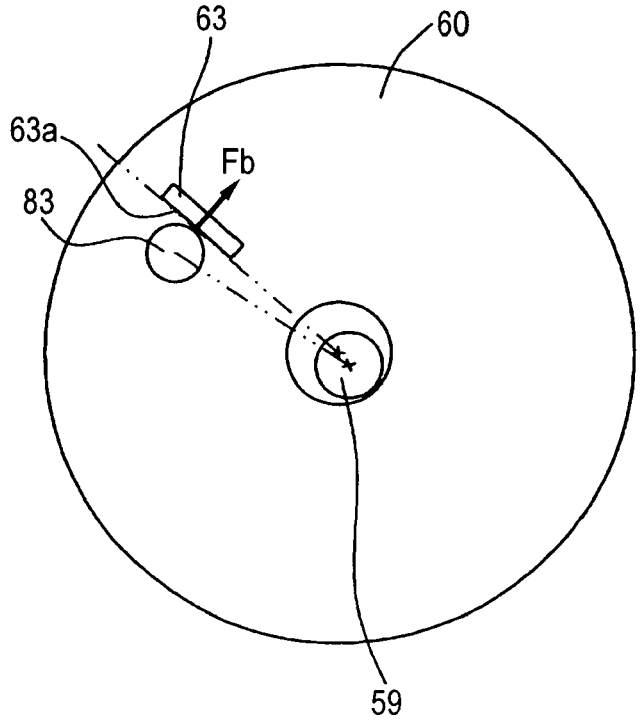
FIG. 7 is a schematic view showing a force applied between the drum gear and the flange.

Meanwhile, the photosensitive drum 25 must be driven to rotate at the constant velocity for the purpose of making density of scanning lines constant, and for this purpose, it is necessary to efficiently transmit the driving force only in a circumferential direction of the photosensitive drum 25. In this aspect, the driving force is transmitted from the boss 83 by contacting with the receiving plate portion 63, as described above. In this case, as shown in FIG. 7, even though a rotation center of the boss 83 (that is, a rotation center of the drum gear 80) is offset from a rotation center of the receiving plate portion 63 (that is, a rotation center of the flange 60), only a force Fb perpendicular to an end face 63*a* of the receiving plate portion 63 is applied from the boss 83. Because the end face 63*a* constitutes apart of a plane containing the center axis of the hole 61, the force Fb has no component in a radial direction of the flange 60. Accordingly, the force in the radial direction is not applied to the photosensitive drum 25, but the force is applied only in the circumferential direction, and it is easy to rotate the photosensitive drum 25 at a constant velocity.

When plural contact points, such as the contact points between the boss 83 and the receiving plate portion 63, transmit the driving force, the rotation center of the flange 60 may be restricted by positional relation between these contact points. However, in this aspect, there are provided a single boss 83 and a single receiving plate 63, and hence, even though the positional relation between them is rather rough, a force for making the flange 60 eccentric is not exerted. In addition, because it is sufficient to provide only one boss 83 and only one receiving plate 63, and their positions may be rather rough, production cost of the photosensitive drum assembly can be reduced.

Further, in a case where the driving force is transmitted when the boss 83 is contacted with the receiving plate portion 63, the flanges 60, 70 and the photosensitive drum 25 may sometimes continue to rotate by inertia, even though rotation of the main body gear 90 stops and transmission of the driving force is interrupted. However, because the boss 83 is provided between the receiving plate portion 63 and the backlash receiving portion 64, in this aspect, the rotation by inertia stops when the boss 83 contacts with the backlash receiving portion 64. Accordingly, the boss 83 always can be arranged close to the receiving plate portion 63, and the photosensitive drum 25 can be rotated more favorably at the constant velocity. Still further, because the receiving plate portion 63, the backlash receiving portion 64, and the boss 83 are integrally formed with the annular ribs 62 and 82 in this aspect, inclination of these members is prevented, and the photosensitive drum 25 can be further favorably rotated at the constant velocity.

The invention is not limited to the above described aspect, but can be carried out in various forms in a scope not deviated from the gist of the invention. For example, a member similar to the receiving plate portion 63 may be provided at the driving side, and a member similar to the boss 83 may be provided at the driven side. Further, although the invention is applied to the photosensitive drum 25 in the laser printer 1 for forming monochrome images in this aspect, the invention can be also applied to a color laser printer in the same manner, and to other rotary bodies besides the photosensitive drum. However, in case where the invention has been applied to the photosensitive drum, more accurate image formation can be performed, by rotating the photosensitive drum at the constant velocity, and the advantage of the invention is more apparently revealed.

Further, it has been described that even though the drum gear 80 and the flange 60 are eccentric, the photosensitive drum 25 can be rotated at a constant velocity. However, it is needless to say that the photosensitive drum 25 can be rotated more favorably at the constant velocity, in a case where eccentricity of both the members can be restrained. In the following, restraining the eccentricity will be described.

Figure 8:
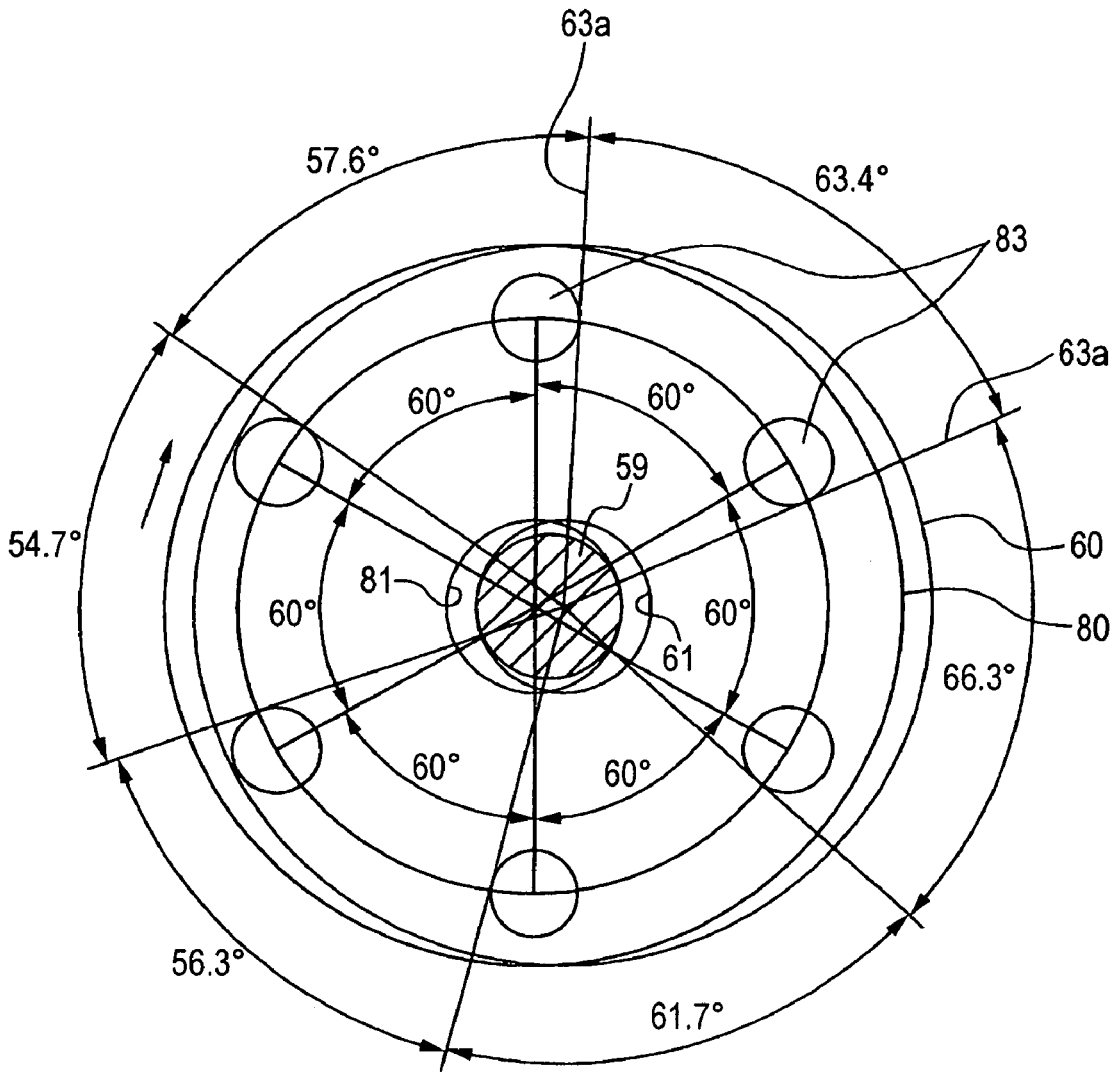
FIG. 8 is an explanatory view showing a rotation error, which occurs by eccentricity of the drum gear with respect to the flange.

FIG. 8 is an explanatory view showing a rotation error, which occurs, when the drum gear 80 and the flange 60 are eccentric in 180° opposite directions, interposing the shaft 59. In FIG. 8, the end face 63*a* of the receiving plate portion 63 is schematically shown as a line, one end of which is positioned at the center of the flange 60. The holes 61, 81 have clearances of about 4 mm with respect to the shaft 59, and an amount of eccentricity between the drum gear 80 and the flange 60 is also about 4 mm, provided that the eccentricity as shown in FIG. 8 is the largest eccentricity. In this case, while the drum gear 80 rotates by 60°, and the boss 83 also rotates by 60°, the end face 63*a* rotates by 54.7°, 57.6°, 63.4°, 66.3°, 61.7°, and 56.3° including the rotation errors. The flange 60 and the photosensitive drum 25 include similar rotation errors.

Figure 9:
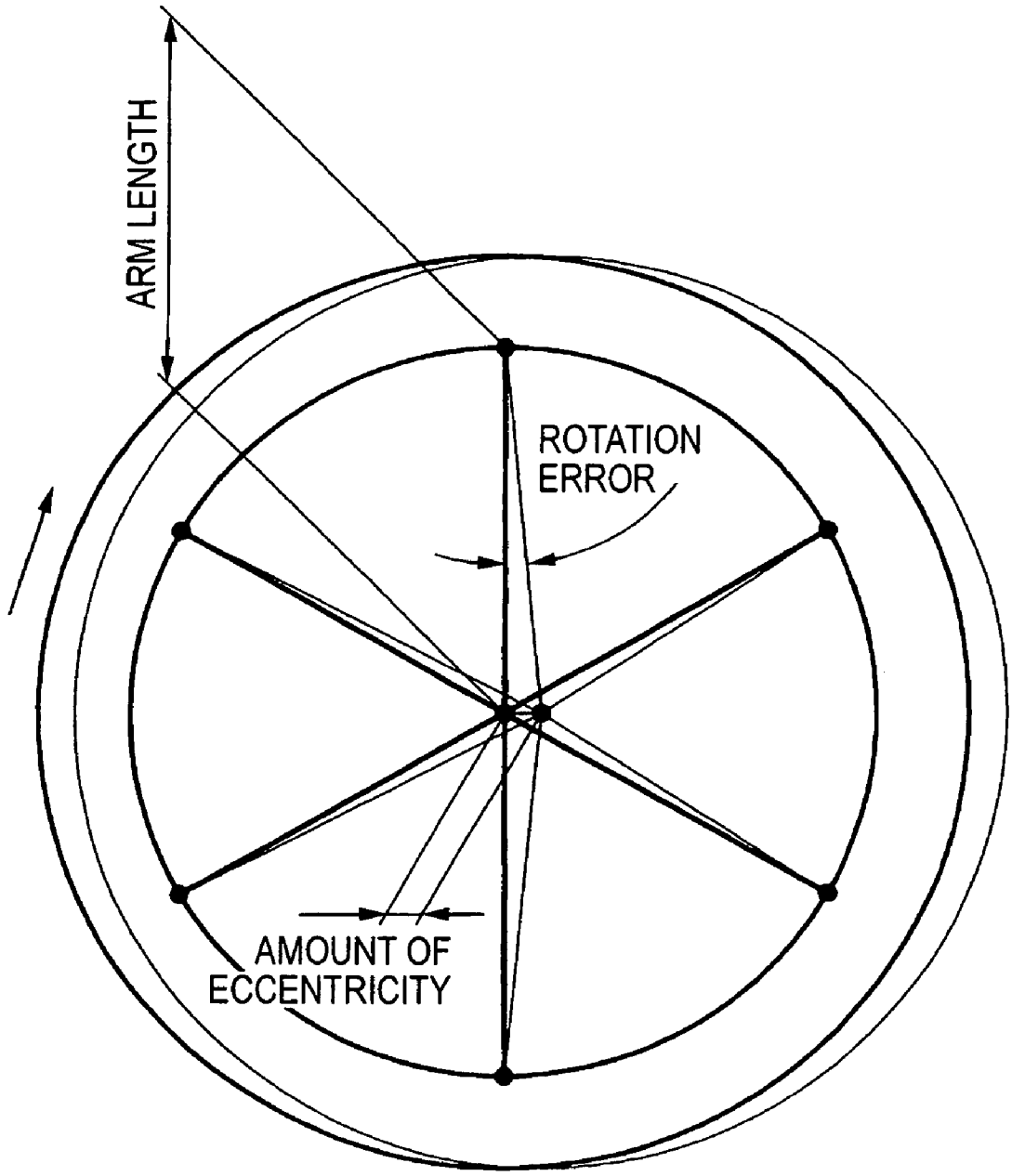
FIG. 9 is an explanatory view showing relation between the rotation error and an amount of eccentricity and an arm length.

The rotation errors are estimated based on a length from the center of the boss 83 to the center of the drum gear 80 (hereinafter referred to as an arm length) is 40 mm. Specifically, as shown in FIG. 9, the rotation errors depend not only on the eccentricity but also on the arm length. In case where a diameter of the photosensitive drum 25 is 24 mm, the arm length is 10 mm, and the eccentricity is 0.01 to 0.05 mm. Therefore, the rotation errors do not cause a problem in normal use of the laser printer for monochrome images.

Figure 10A:
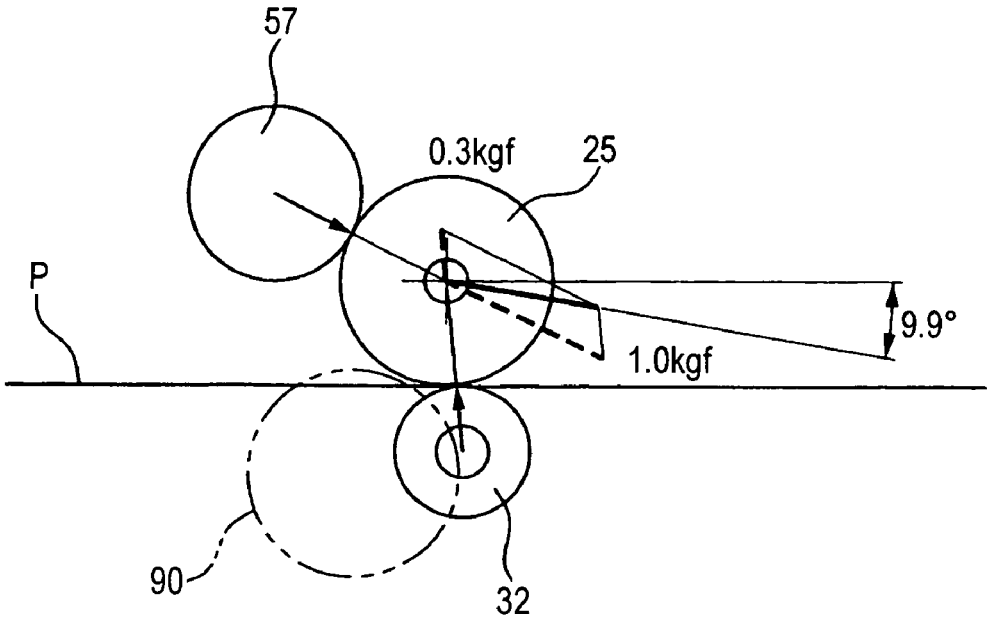
FIGS. 10A and 10B are explanatory views showing the aspect in which a structure for decreasing the eccentricity is provided.
Figure 10B:
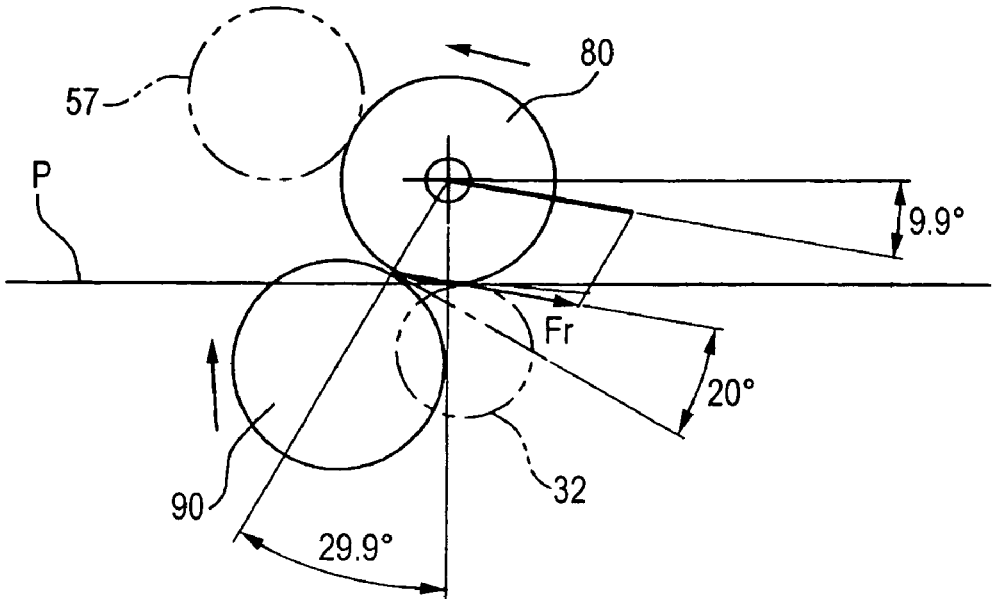

However, in order to improve accuracy of image formation, it is necessary to increase the diameters of the flange 60 and the drum gear 80 to increase the arm length or to decrease the eccentricity. In this aspect, directions of eccentricity (hereinafter referred to directions of hole backlash) of the holes 61, 81 with respect to the shaft 59 are made consistent as follows. As shown in FIG. 10A, the developing roller 57 is in pressure contact with the photosensitive drum 25 at 1.0 kgf, and the transfer roller 32 as the process member too is in pressure contact with the photosensitive drum 25 at 0.3 kgf, in this aspect. Accordingly, the resultant force of the pressures, which are applied from the developing roller 57 and the transfer roller 32 to the photosensitive drum 25 is inclined downwardly by 9.9° with respect to the conveying direction of the sheet P. FIGS. 10A and 10B show the members from a direction reverse to the direction in FIGS. 1 and 6, with the conveying direction of the sheet P opposite to the conveying direction in FIGS. 1 and 6.

The main body gear 90 is arranged so as to be meshed with the drum gear 80 in a direction, which is offset by 29.9° backward in the sheet conveying direction from a position vertically below the shaft 59, as shown in FIG. 10B. In this aspect, a gear ratio of the main body gear 90 to the drum gear 80 is set so that the urging force Fr in a direction inclined toward the drum gear 80 by 20°, which is an angular component of gear meshing pressure, is applied to the drum gear 80. Accordingly, the urging force Fr is also exerted in a direction inclined downwardly by 9.9° with respect to the conveying direction of the sheet P.

Figure 11:
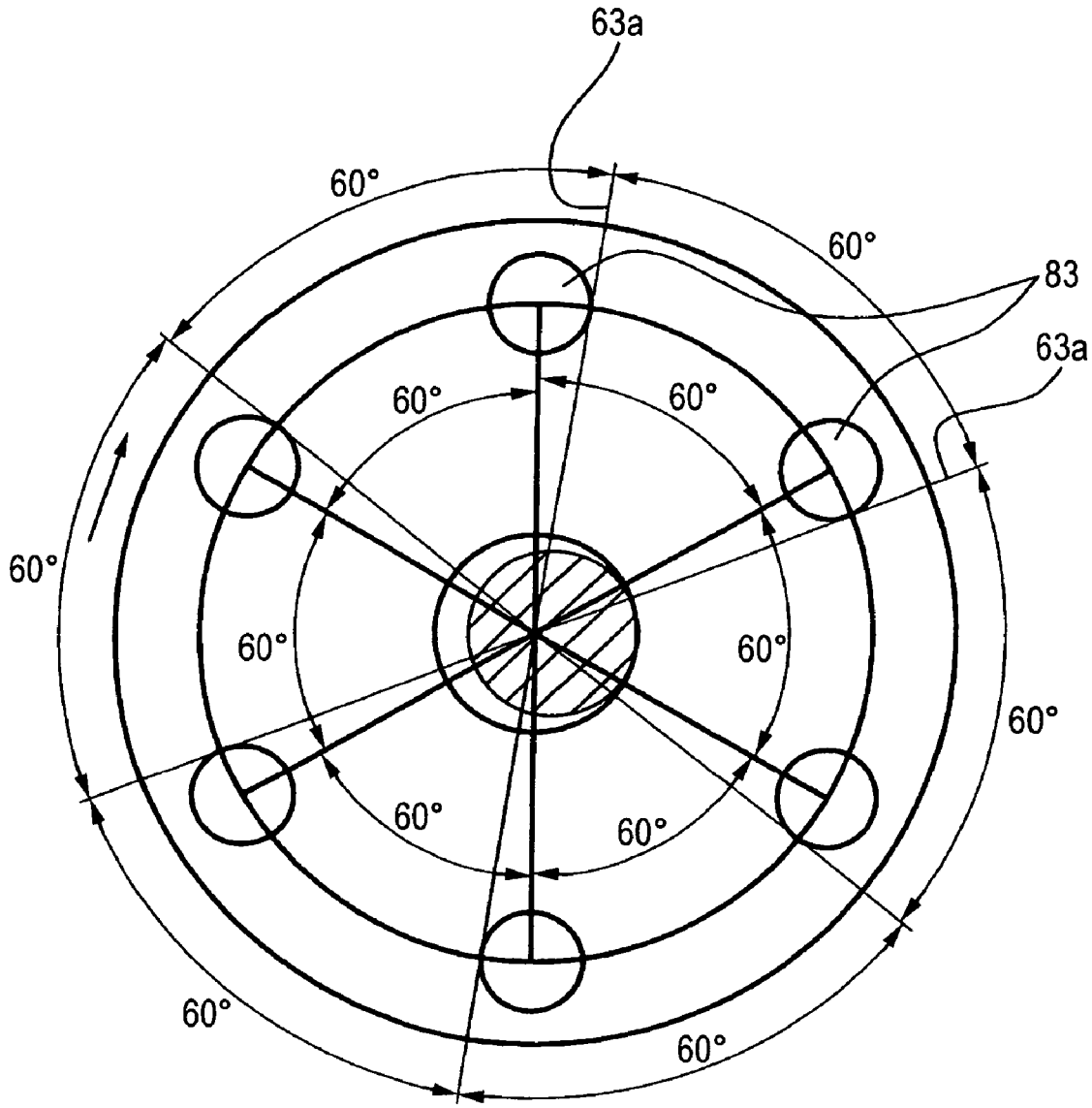
FIG. 11 is an explanatory view showing an effect of the aspect.

The directions of the hole backlashes of both the flange 60 and the drum gear 80 are made consistent, and the rotation centers of both the members become overlapped, as shown in FIG. 11. Accordingly, when the boss 83 rotates by 60°, the end face 63*a* also rotates by 60°, and the rotation errors are favorably restrained. The above aspect can be applied in case where the rotation errors must be excluded as in a color laser printer of tandem type.

In order to prevent the eccentricity between the flange 60 and the drum gear 80, both members may be integrally formed. However, shapes of the members are complicated, and improving accuracy becomes difficult, particularly in case of resin molding. By contrast, in the above aspect, it is possible to favorably restrain occurrence of the rotation errors, by employing a member having a simple shape.

Figure 12A:
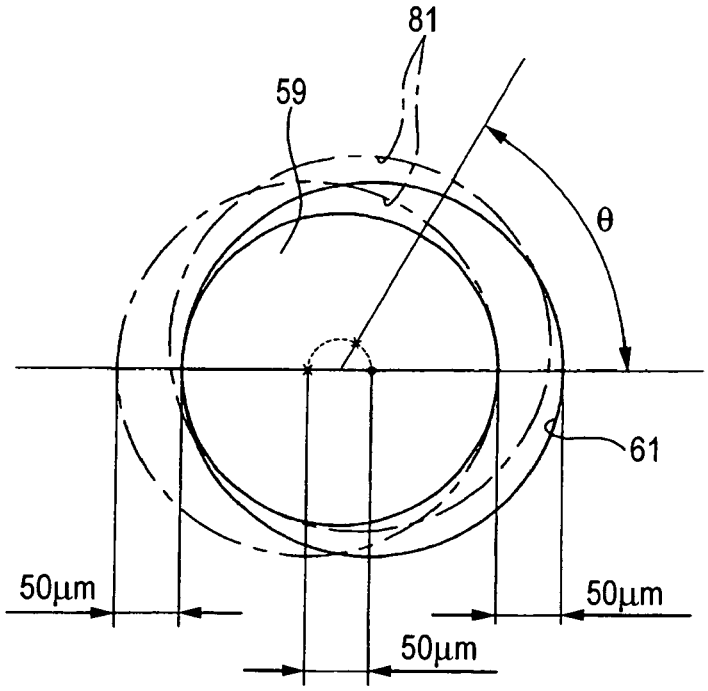
FIGS. 12A and 12B are explanatory views showing relation between the eccentricity and an angular error in a direction of hole backlash.

However, in the above described aspect, it is difficult to make the directions of the hole backlashes completely consistent between the flange 60 and the drum gear 80. In view of the above, FIGS. 12A and 12B show a relation between the angular error θ in the direction of the hole backlash and the eccentricity of the rotation centers between the flange 60 and the drum gear 80.

Although the clearances have been described as 4 mm for convenience of explanation, the holes 61, 81 have the clearances of about 50 μm with respect to the shaft 59 in an actual mechanism. In case where the angle θ is 180°, the eccentricity of the drum gear 80 to the flange 60 is also 50 μm. In case where the angle θ is 0°, the eccentricity is also 0. As the rotation centers are shown by "x" and "." in FIG. 12A, in case where $0° < \theta < 180°$, the eccentricity between the drum gear 80 and the flange 60 is a length of a base of an isosceles triangle, which has a vertical angle θ and two sides adjacent the vertical angle having a length of 25 μm. Accordingly, the eccentricity α (unit: μm) is obtained by the following formula.

$$\alpha = 25 \times 2 \times \sin(\theta/2)$$

Figure 12B:
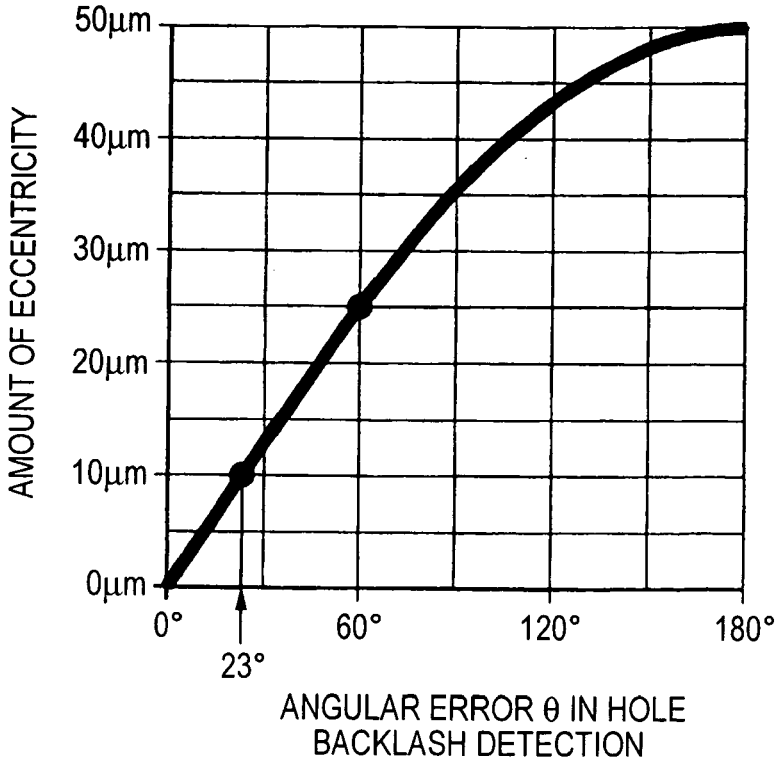

A relation between the angular error θ and the eccentricity obtained above is shown in FIG. 12B. On the other hand, in case of resin molding, dimensional errors of about ±25 μm occur normally. Even under a strict control, dimensional errors are about ±10 μm. The members should be designed so that the eccentricity may be 25 μm or less, preferably, 10 μm or less. Accordingly, it is desirable that the angular error in the direction of the hole backlash corresponding to the above may be 60° or less, more preferably, 23° or less.

What is claimed is:

1. An image forming apparatus, comprising:

a developing unit;

a transfer unit; and a photosensitive drum assembly, which includes:

a photosensitive drum;

a driven section, which is provided integrally with the photosensitive drum; and a driving section, which transmits a driving force to the driven section to rotate the photosensitive drum, wherein either one of the driven section and the driving section comprises a contact face, which constitutes a part of a plane including a rotation axis of the photosensitive drum, and the other of the driven section and the driving section comprises a single boss, which is substantially in parallel with the rotation axis and contacts with the contact face;

wherein an outer periphery of the photosensitive drum and an outer periphery of a member having the driving section are formed in a shape of cylindrical faces of concentric circles.

2. The image forming apparatus as claimed in claim 1, wherein the driven section has the contact face, and the driving section has the boss.

3. The image forming apparatus as claimed in claim 2, wherein a member having the driving section has an annular rib that prevents inclination of the boss.

4. The image forming apparatus as claimed in claim 1, wherein the boss has a columnar shape.

5. The image forming apparatus as claimed in claim 1, wherein the one of the driven section and the driving section has a backlash receiving face, which is opposed to the contact face, the boss being interposed between the backlash receiving face and the contact face.

6. The image forming apparatus as claimed in claim 5, wherein an annular rib is provided on a back face of the contact face in a part to which a force is applied from the boss.

7. The image forming apparatus as claimed in claim 5, wherein a T-shaped rib is provided on a back face of the contact face in a part to which a force is applied from the boss.

8. The image forming apparatus as claimed in claim 1, further comprising a driving gear, wherein the driving section comprises a member, wherein the driving gear acts on the member to drive the photosensitive drum, and wherein a direction of a resultant force of a force applied from the developing unit to the photosensitive drum and a force applied from the transfer unit to the photosensitive drum, and a direction of a force applied from the driving gear to the member are substantially the same.

9. The image forming apparatus as claimed in claim 1, further comprising a shaft member, wherein the driving section comprises a member having a hole at the center thereof, wherein the driven section has a hole in the center thereof, and wherein the shaft member has a smaller diameter than the holes in the driven section and the member, and is inserted into the holes in the driven section and the member.

10. A photosensitive drum assembly, comprising:

a photosensitive drum;

a driven section, which is provided integrally with the photosensitive drum; and a driving section, which transmits a driving force to the driven section to rotate the photosensitive drum, wherein either one of the driven section and the driving section has a contact face, which constitutes a part of a plane including a rotation axis of the photosensitive drum, and the other of the driven section and the driving section is a single boss, which is substantially in parallel with the rotation axis and contacts with the contact face;

wherein an outer periphery of the photosensitive drum and an outer periphery of a member having the driving section are formed in a shape of cylindrical faces of concentric circles.

11. The photosensitive drum assembly as claimed in claim 10, wherein the driven section has the contact face, and the driving section is the boss.

12. The photosensitive drum assembly as claimed in claim 11, wherein a member having the driving section has an annular rib that prevents inclination of the boss.

13. The photosensitive drum assembly as claimed in claim 10, wherein the boss has a columnar shape.

14. The photosensitive drum assembly as claimed in claim 10, wherein the one of the driven section and the driving section has a backlash receiving face, which is opposed to the contact face, the boss being interposed between the backlash receiving face and the contact face.

15. The photosensitive drum assembly as claimed in claim 14, wherein an annular rib is provided on a back face of the contact face in a part to which a force is applied from the boss.

16. The photosensitive drum assembly as claimed in claim 14, wherein a T-shaped rib is provided on a back face of the contact face in a part to which a force is applied from the boss.

17. The photosensitive drum assembly as claimed in claim 10, further comprising a shaft member, wherein the driving section comprises a member having a hole at the center thereof, wherein the driven section has a hole in the center thereof, and wherein the shaft member has a smaller diameter than the holes in the driven section and the member and is inserted into the holes in the driven section and the member.

18. A driving force transmitting mechanism for a rotary body comprising:

a driven section, which is provided integrally with the rotary body; and a driving section, which transmits a driving force to the driven section to rotate the rotary body, wherein either one of the driven section and the driving section has a contact face, which constitutes a part of a plane including a rotation axis of the rotary body, and the other of the driven section and the driving section is a single boss, which is formed substantially in parallel with the rotation axis and contacts with the contact face;

wherein an outer periphery of the rotary body and an outer periphery of a member having the driving section are formed in a shape of cylindrical faces of concentric circles.

* * * * *